US007048593B2

(12) United States Patent
Matsuoka

(10) Patent No.: US 7,048,593 B2
(45) Date of Patent: May 23, 2006

(54) CONNECTOR, A METHOD OF MOLDING IT AND A MOLD THEREFOR

(75) Inventor: Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/866,203

(22) Filed: Jun. 10, 2004

(65) Prior Publication Data

US 2004/0253883 A1 Dec. 16, 2004

(30) Foreign Application Priority Data

Jun. 13, 2003 (JP) ..... 2003-169830

(51) Int. Cl.
*H01R 13/439* (2006.01)

(52) U.S. Cl. ..... 439/736; 264/275

(58) Field of Classification Search ..... 264/275, 264/328.1, 328.9; 439/736, 752
See application file for complete search history.

(56) References Cited

U.S. PATENT DOCUMENTS 6,358,101 B1 * 3/2002 Noro et al. ..... 439/752
6,435,919 B1 8/2002 Saka et al.
6,878,018 B1 * 4/2005 Miyakawa et al. ..... 439/752

FOREIGN PATENT DOCUMENTS

| | | |
|---|---|---|
| DE | 693 02 355 T2 | 4/1996 |
| DE | 693 15 432 T2 | 5/2002 |
| DE | 102 12 660 A1 | 11/2002 |
| DE | 101 61 513 B4 | 11/2005 |
| JP | 5-90852 | 12/1993 |

* cited by examiner

*Primary Examiner*—Neil Abrams
(74) *Attorney, Agent, or Firm*—Gerald E. Hespos; Anthony J. Casella

(57) ABSTRACT

A connector housing (10) is molded using three molds (40, 50, 60). Mold parts (61*a*, 61*b*) pass from the exterior through a mold-removal hole (21) in a tube (14) of the housing and into a mold fitting space (41) in an interior mold (40). A beam (22) extends between two edges (21*e*) of the mold-removal hole (21) that are substantially normal to a removing direction of the first mold (40). Thus, the mold-removal hole (21) is divided into divided holes (21*a*, 21*b*) along a direction substantially normal to the removing direction of the first mold (40). Dimensions of the divided holes (21*a*, 21*b*) along the removing direction of the first mold (40) are small. Thus, an opening edge (41*e*) of the mold fitting space (41) of the first mold (40) is not likely to catch and damage the opening edge (21*e*) of the mold-removal hole (21).

4 Claims, 10 Drawing Sheets

CONNECTOR, A METHOD OF MOLDING IT AND A MOLD THEREFOR

BACKGROUND OF THE INVENTION

1. Field of the Invention

The invention relates to a connector, to a method of molding it and to a mold therefor.

2. Description of the Related Art

Japanese Unexamined Utility Model Publication No. H05-90852 discloses a connector with a housing made of a synthetic resin. A fittable tube is molded integrally with the housing and substantially surrounds at least a portion of the housing. The housing is configured to accommodate terminal fittings, and a retainer is mounted in the housing to lock the terminal fittings. The retainer is mounted into the housing in a direction normal to an opening direction of the fittable tube. Thus, a mount hole is formed in the fittable tube and the retainer is mounted into the housing through the mount hole.

The housing of the above-described connector requires a first mold to be removed in the opening direction of the fittable tube to form the fittable tube and the housing. A second mold must be removed in the direction normal to the opening direction of the fittable tube to form the mount hole. The second mold may become narrower depending on the shape of the housing. In such a case, a mold-removal hole must be formed at a position on the fittable tube opposite the mount hole. Thus, a third mold to be removed in a direction opposite from the second mold is used to form the mold-removal hole.

The first mold is removed after the second and third molds are removed. Thus, a recess corresponding to the mold-removal hole is required on the surface of the first mold that forms the inner peripheral surface of the fittable tube. The opening edge of the recess facing the inner peripheral surface of the fittable tube is angled. This angled edge may catch and damage the edge of the mold-removal hole as the first mold is being removed. This problem is prominent when the mold-removal hole is wide in a direction normal to a removing direction of the first mold.

The inner periphery of the fittable tube can be widened or stepped along the mold removing direction to prevent the angled opening edge from getting caught by the edge of the mold-removal hole. However, the widened or stepped fittable tube is larger, and hence the entire connector is larger.

The present invention was developed in view of the above problems, and an object thereof is to prevent a mold from getting caught by an edge of a mold-removal hole.

SUMMARY OF THE INVENTION

The invention relates to a connector with a synthetic resin housing and at least one terminal fitting mounted in the housing. An accommodation space is formed in the housing for accommodating a retainer that locks the terminal fitting in the housing. A forwardly open fittable tube at least partly surrounds the housing, and a mount hole penetrates the fittable tube. Thus, the retainer can be inserted through the mount hole of the fittable tube and into the accommodation space of the housing. A mold-removal hole penetrates the fittable tube at a side substantially opposite the mount hole and at least one beam extends between two edges of the mold-removal hole At least part of the inner peripheral surface of the fittable tube is formed by a first mold to be removed in a first removing direction. The mount hole and part of the accommodation space are formed by a second mold to be removed in a second removing direction substantially normal to the first removing direction. The mold-removal hole and a remaining part of the accommodation space are formed by a third mold that cooperates with the second mold. The third mold is to be removed in a third removing direction substantially opposite from the second removing direction. The beam that extends between two edges of the mold-removal hole that are aligned at an angle, preferably a substantially right angle, to the first removing direction.

The first mold is removed after the second and third molds are removed. Thus, a recess corresponding to the mold-removal hole is left on a molding surface of the first mold for forming the inner peripheral surface of the fittable tube after the removal of the third mold. Accordingly, there is a possibility that the angled opening edge of the recess will catch the edge of the mold-removal hole as the first mold is removed. However, the beam extends between the two edges of the mold-removal hole at an angle to the first removing direction. Thus, the mold-removal hole is divided along the direction at an angle to the first removing direction. Dimensions of the respective divided holes along the direction at an angle to the first removing direction are short. Thus, the opening edge of the recess of the first mold is less likely to get caught by the opening edge of the mold-removal hole as compared to a case where the mold-removal hole has a large opening without being divided by the beam.

Therefore, the connector can be made smaller as compared to a case where the inner surface of the fittable tube is widened or stepped along the mold removing direction or stepped.

At least one rib preferably is formed on the outer surface of the beam and extends along the first removing direction. The rib enhances the rigidity of the beam. Thus, beam is less likely to deform and inward displacement of the opening edge of the mold-removal hole is less likely. Accordingly interference of the opening edge of the mold-removal hole with the first mold is avoided more securely.

A thick portion preferably is formed on the outer surface of the fittable tube over a range including an area that extends along the opening edge of the mold-removal hole. The thick portion further prevents inward displacement of the opening edge of the mold-removal hole. The rib preferably is substantially continuous with the thick portion. Thus, displacement of the rib is restricted further by the thick portion to improve a reinforcing function of the rib.

The invention also relates a method for forming the above-described connector. The method comprises arranging first, second and third molds. The method then includes removing the first mold in a first removing direction to form at least part of the inner peripheral surface of the fittable tube, removing the second mold in a second removing direction substantially normal to the first removing direction to form the mount hole and at least part of the accommodation space, and removing the third mold in a third removing direction substantially opposite from the second removing direction to form at least part of the accommodation space in cooperation with the second mold and to form the mold-removal hole in the fittable tube. The mold-removal hole is formed with at least one beam extending between two edges of the mold-removal hole at an angle, preferably substantially normal to the first removing direction.

The method may further include forming at least one rib on the outer surface of the beam to extend substantially along the first removing direction.

The method may further include forming a thick portion on the outer surface of the fittable tube over a range at least partly including an area extending along the opening edge of the mold-removal hole. The rib preferably is formed substantially continuous with the thick portion.

The invention also is directed to a mold assembly for molding the above-described connector. The mold assembly comprises a first mold removable in a first removing direction to form at least part of the inner peripheral surface of the fittable tube, a second mold removable in a second removing direction substantially normal to the first removing direction to form the mount hole and at least part of the accommodation space, and a third mold removable in a third removing direction substantially opposite from the second removing direction to form at least part of the accommodation space in cooperation with the second mold and to form the mold-removal hole in the fittable tube. At least one of the molds is formed to define at least one beam extending between two edges of the mold-removal hole at an angle, preferably substantially a right angle, to the first removing direction.

These and other features of the invention will become more apparent upon reading the following detailed description and accompanying drawings. It should be understood that even though embodiments are described separately, single features thereof may be combined to additional embodiments.

DETAILED DESCRIPTION OF THE PREFERRED EMBODIMENTS

Figure 1:
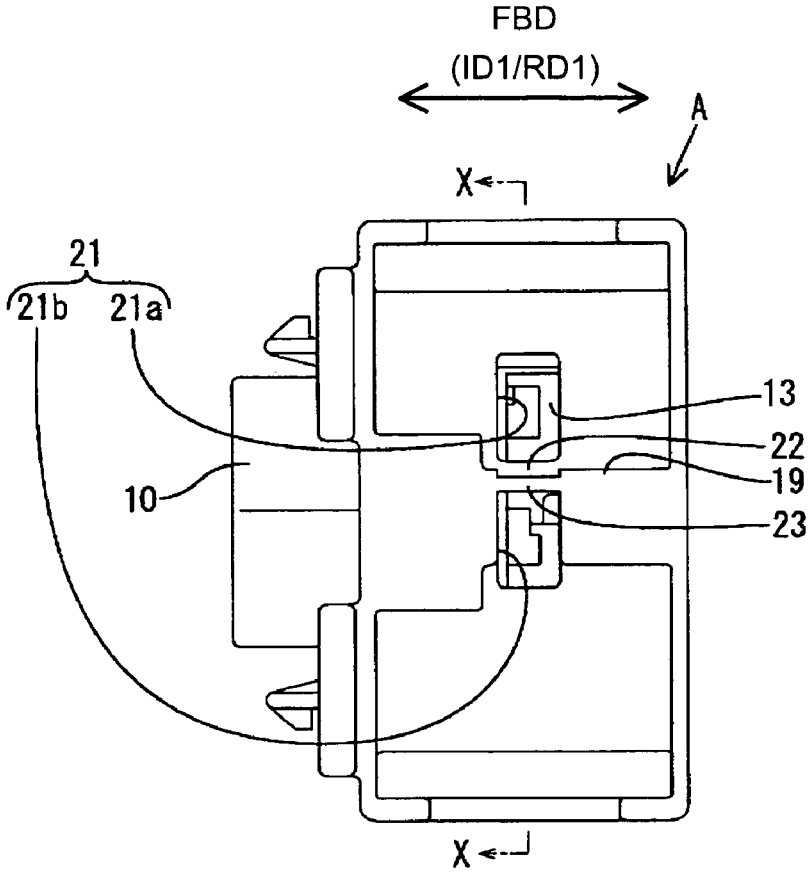
FIG. 1 is a side view of a connector.
Figure 2:
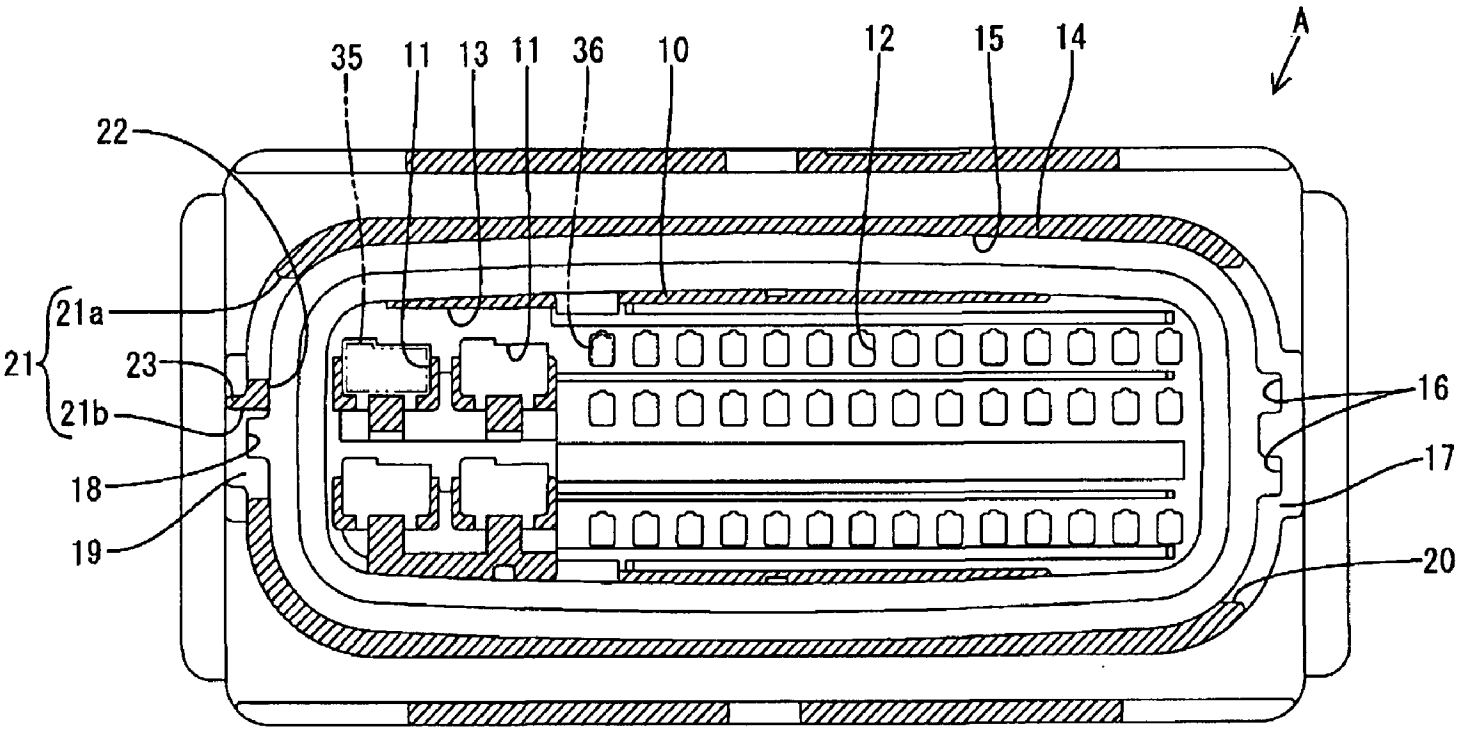
FIG. 2 is a section along 2—2 of FIG. 1.
Figure 3:
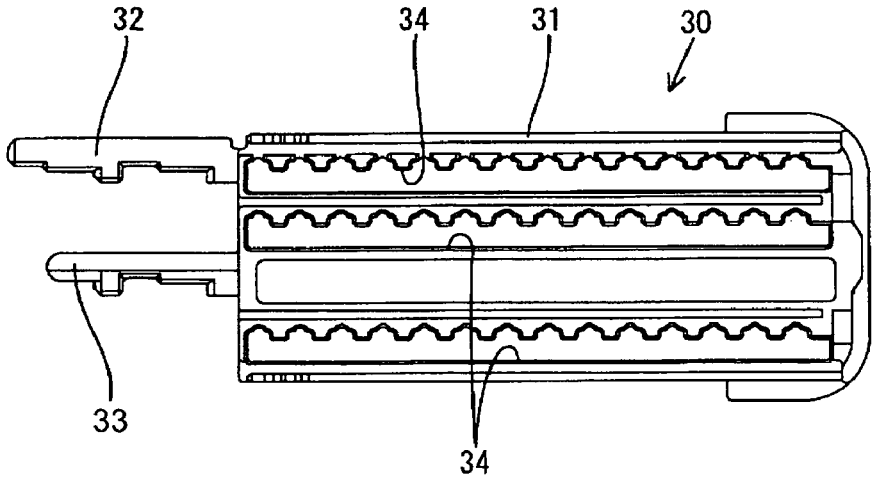
FIG. 3 is a front view of a retainer.
Figure 4:
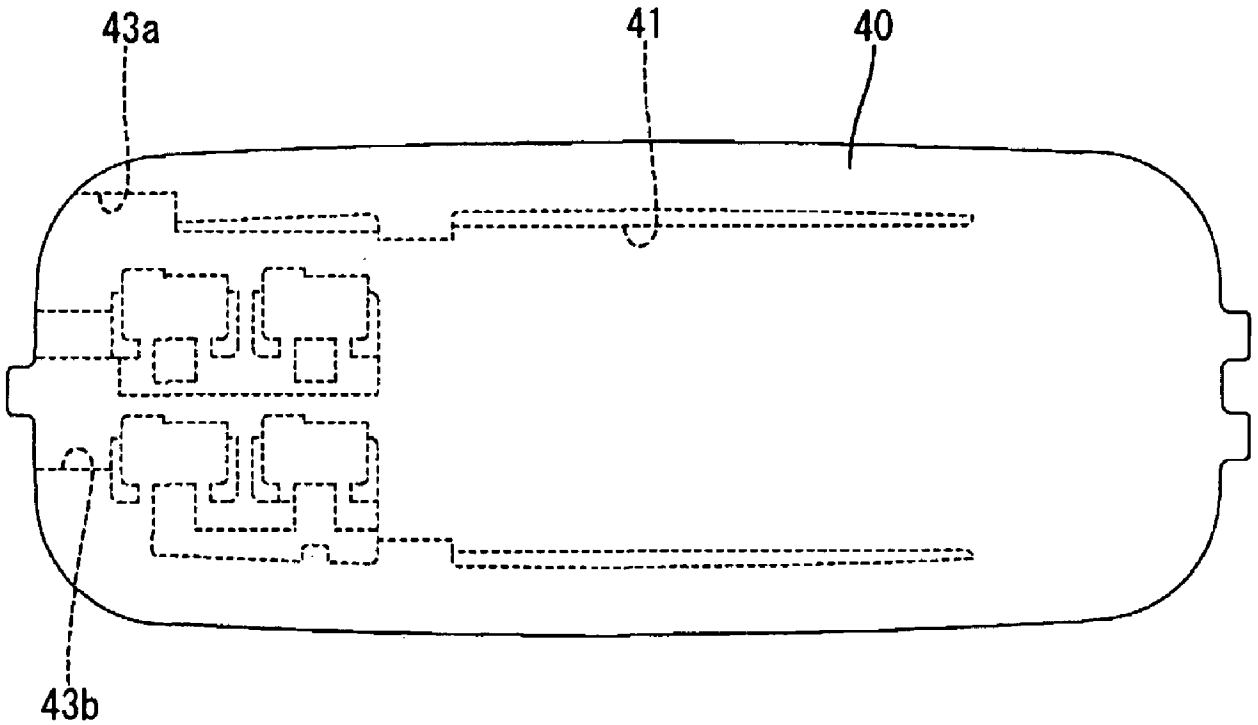
FIG. 4 is a front view of a first mold.
Figure 5:
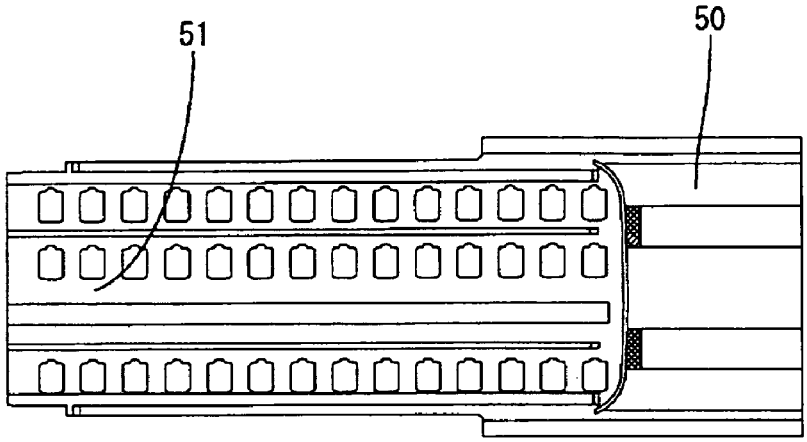
FIG. 5 is a front view of a second mold.
Figure 6:
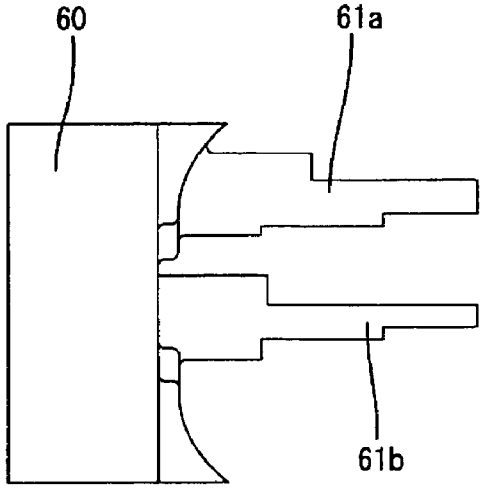
FIG. 6 is a front view of a third mold.

A connector according to the invention is identified by the letter A in FIGS. 1 and 2. In the following description, a mating side of the connector A with a mating connector (not shown) is referred to as the front side.

The connector A has a housing 10 made e.g. of a synthetic resin. The housing 10 is a wide rectangular parallelepiped with four arcuate outer corners. Large and small cavities 11 and 12 penetrate the housing 10 substantially along forward and backward directions for accommodating the large and small terminal fittings 35 and 36 respectively. The large cavities 11 are arranged in a 2×2 array at the left end of the housing 10 when viewed from the front. The small cavities 12 are formed in a wide area at the right side of the large cavities 11 and are arranged transversely substantially side by side at upper, middle and lower stages. The terminal fittings 35, 36 are inserted into the corresponding cavities 11, 12 from behind.

An accommodation space 13 is formed in the housing 10 and is open in the opposite left and right surfaces of the outer surfaces of the housing 10 (i.e. transversely penetrates the housing 10). The accommodation space 13 communicates with all the cavities 11, 12.

A retainer 30 is made e.g. of a synthetic resin and is mountable in the accommodation space 13 for locking the terminal fittings 35 and 36 in the respective cavities 11 and 12. The retainer has a main portion 31 substantially in the form of a wide rectangular plate, and upper and lower engaging pieces 32, 33 project forward from a distal part of the main portion 31. The plate is narrow and long in the mounting direction of the retainer 30 into the accommodation space 13. The main portion 31 has long narrow through holes 34 arranged at upper, middle and lower stages corresponding to the small cavities 12 in the housing 10. An upper side of each through hole 34 serves as an engaging portion for locking the small terminal fitting 36 in the corresponding small cavity 12. Upper and lower engaging pieces 32, 33 correspond to the larger cavities 11 at the upper and lower stages and lock the large terminal fittings 35 in the large cavities 11. No detailed description is given on a construction for locking the terminal fittings 35, 36 by the retainer 30 and a construction for interlocking the retainer 30 with the housing 10 since these constructions take advantage of known technologies.

The housing 10 is formed integrally with a forwardly open fittable tube 14 that surrounds the housing 10 over substantially the entire periphery. The surrounding wall of the fittable tube 14 has a substantially constant thickness over the entire periphery, and the fittable tube 14 and the outer peripheral surface of the housing 10 are similar to each other in shape. An annular fitting space 15 is defined between the inner peripheral surface of the fittable tube 14 and the outer peripheral surface of the housing 10. The fitting space 15 has a substantially wide rectangular shape with four rounded corners and a receptacle of an unillustrated mating connector can fit into the fitting space 15.

Upper and lower error connection preventing grooves 16 are formed inside the fitting space 15 on a first lateral portion of the fittable tube 14. The error connection preventing grooves 16 extend substantially straight along forward and backward directions parallel to a connecting direction with the mating connector and open at the front mating end of the fittable tube 14. A thick portion 17 bulges out in area of the surrounding wall of the fittable tube 14 including the error connection preventing grooves 16 and sides above and below the grooves 16.

One error connection preventing groove 18 is formed inside the fitting space 15 in a second lateral portion of the surrounding wall of the fittable tube 14 substantially opposite the first lateral portion. The error connection preventing groove 18 extends substantially straight along forward and backward directions and opens at the front end of the fittable tube 14. A thick portion 19 bulges out in area of the surrounding wall of the fittable tube 14 including the error connection preventing groove 18 and sides above and below the groove 18.

A mount hole 20 transversely penetrates the first lateral wall portion of the fittable tube 14 and provides communication with the accommodation space 13 from the outer surface of the housing 10. The mount hole 20 has a substantially rectangular shape narrow along the vertical direction VD and substantially conforms to the shape of the opening of the accommodation space 13. Thus, the retainer 30 can be inserted into the mount hole 20 without shaking in a vertical (VD) or forward and backward directions.

A mold-removal hole 21 penetrates the second lateral wall portion of the fittable tube 14 along a transverse direction TD that is substantially normal to the vertical direction VD and corresponds to the opening of the accommodation space 13 in the outer peripheral surface of the housing 10. The mold-removal hole 21 is provided for molding accuracy. More particularly, the accommodation space 13 for the retainer 30 is long and narrow in the transverse direction TD, which is substantially normal to the inserting direction of the terminal fittings 35/36 into the respective cavities 11/12. A single mold to form the accommodation space 13 also would be long and narrow and hence could be deformed by injection pressure during molding. Thus, a mold is inserted substantially parallel to the transverse direction TD through an opening in the right side surface of the housing 10 to form part of the accommodation space 13. Another mold is inserted through an opening in the left side surface of the housing 10 to form the remainder of the accommodation space 13. Each of these molds is shorter, and hence is less likely to be deformed by injection pressure during molding. The mold-removal hole 21 is provided to remove the additional mold.

The accommodation space 13 is vertically long and narrow. Thus, the opening of the mold-removal hole 21 has a vertically long and narrow shape similar to the mount hole 20. However, a beam 22 extends substantially along forward and backward directions FBD between vertically extending front and rear opening edges of the mold-removal hole 21. Accordingly, the beam 22 divides the mold-removal hole 21 into upper and lower divided holes 21*a*, 21*b*. The dimensions of the respective divided holes 21*a*, 21*b* along the vertical direction VD are shorter than the mold-removal hole 21. The upper divided hole 21*a* is above the thick portion 19 and an upper portion (preferably a substantially upper ⅔ or more) of the lower divided hole 21*b* corresponds to the thick portion 19. The beam 22 is at the substantially same height as the upper end of the thick portion 19.

Figure 8:
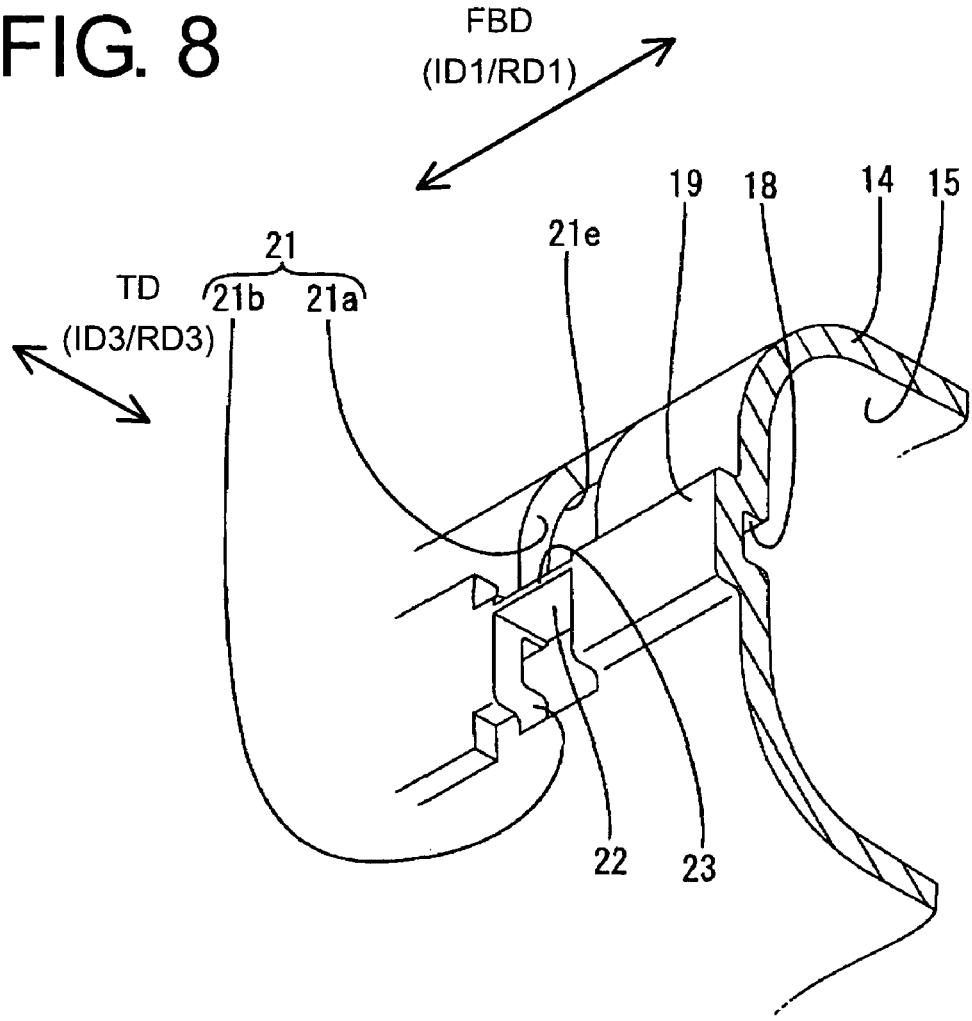
FIG. 8 is a schematic perspective view of a fittable tube when viewed from outer side.

A rib 23 projects outward along the lower edge of the beam 22 and extends substantially along the extending direction (i.e. forward and backward directions) of the beam 22. The outer surface of the rib 23 is substantially continuous and flush with the outer surface of the thick portion 19 formed on the outer surface of the fittable tube 14. The thick portion 19 substantially faces the front and rear opening edges of the divided holes 21*a*, 21*b*, and a facing area of the thick portion 19 includes an area where the beam 22 is formed (refer e.g. to FIG. 8).

A first mold 40 is provided for forming the inner peripheral surface of the fittable tube 14, the outer peripheral surface of the housing 10 and the cavities 11, 12 in the housing 10. The first mold 40 is removed forward with respect to the housing 10 and the fittable tube 14 in a first removing direction RD1 that is substantially normal to a mounting direction MD of the retainer 30 into the housing 10. A mold fitting space 41 penetrates the first mold 40 and has open left and right ends when viewed from the front. An opening 42 at the right side of the mold fitting space 41 substantially corresponds to the mount hole 20 of the fittable tube 14 on the outer surface of the first mold 40. Upper and lower openings 43*a*, 43*b* at the left side of the mold fitting space 41 substantially correspond to the two upper and lower divided holes 21*a*, 21*b* of the fittable tube 14 on the outer surface of the first mold 40.

A second mold 50 is provided for forming an area of the accommodation space 13 corresponding to the small cavities 12, and the mount hole 20. The second mold 50 is removed substantially rightward with respect to the housing 10 in a second removing direction RD2 that is substantially normal to the first removing direction RD1. The second mold 50 is fit in the mold fitting space 41 of the first mold 40, excluding a left-end portion.

The third mold 60 is provided for forming an area of the accommodation space 13 corresponding to the large cavities 11, the divided holes 21*a*, 21*b*, and a left surface area of the outer circumferential surface of the fittable tube 14. The third mold 60 has upper and lower molding portions 61*a*, 61*b* that project rightward in the inserting direction ID3 to form the area of the accommodation space 13 corresponding to the large cavities 11. The third mold 60 is removed leftward in a third removing direction RD3 that is substantially normal to the first removing direction RD1 and opposite from the second removing direction RD2. The upper and lower molding portions 61*a*, 61*b* of the third mold 60 fit in the openings 43*a*, 43*b* at the left side of the mold fitting space 41 of the first mold 40.

Figure 7:
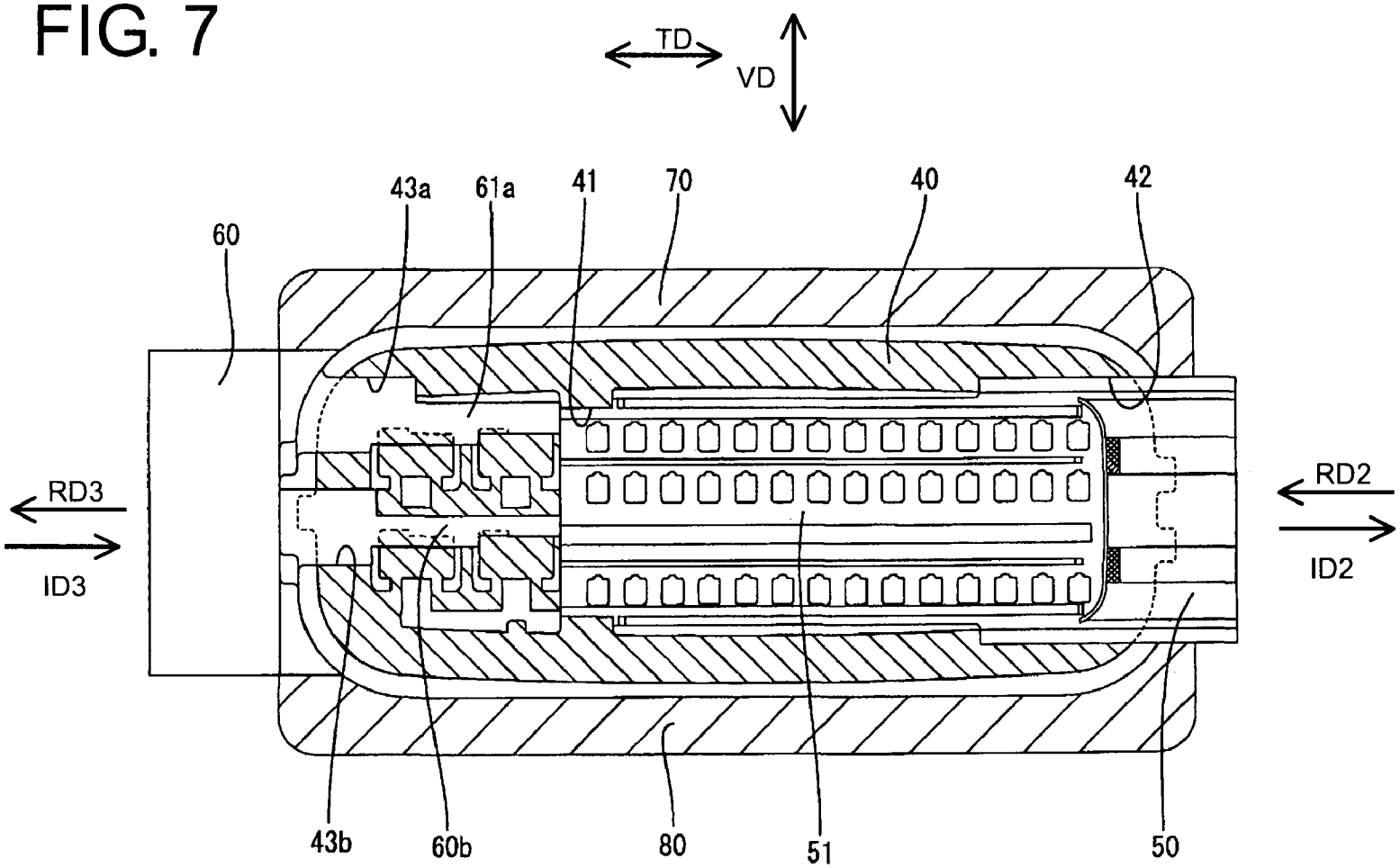
FIG. 7 is a section showing the first to third molds clamped.

The molds 40, 50, 60 are clamped to form the housing 10 and the fittable tube 14. At this time, the second mold 50 and the molding portions 61*a*, 61*b* of the third mold 60 are fit in the respective inserting direction ID2/ID3 in the mold fitting space 41 of the first mold 40. Fourth and fifth molds 70, 80 for forming the outer circumferential surface of the fittable tube 14 are set from outside (e.g. from above and below) the first mold 40 (see FIG. 7). Although not shown, necessary molds are set in addition to the first to fifth molds 40 to 80, and a molten resin is filled into a molding space defined by the respective molds 40 to 80.

The molds are opened after the resin is solidified or cured. Upon opening the molds, the second and third molds 50, 60 are removed in opposite directions away from the first mold 40. In this state, the right opening 42 of the mold fitting space 41 in the outer surface of the first mold 40 corresponds to the mount hole 20. Thus, the opening edges of the opening 42 and the mount hole 20 substantially align and the inner surfaces thereof are substantially continuous and flush with each other. Likewise, the upper and lower openings 43*a*, 43*b* at the left side of the mold fitting space 41 in the outer surface of the first mold 40 correspond to the upper and lower divided holes 21*a*, 21*b*. Thus, the opening edges of the openings 43*a*, 43*b* and the divided holes 21*a*, 21*b* substantially align and the inner surfaces thereof are substantially continuous with and in flush with each other.

Figure 9:
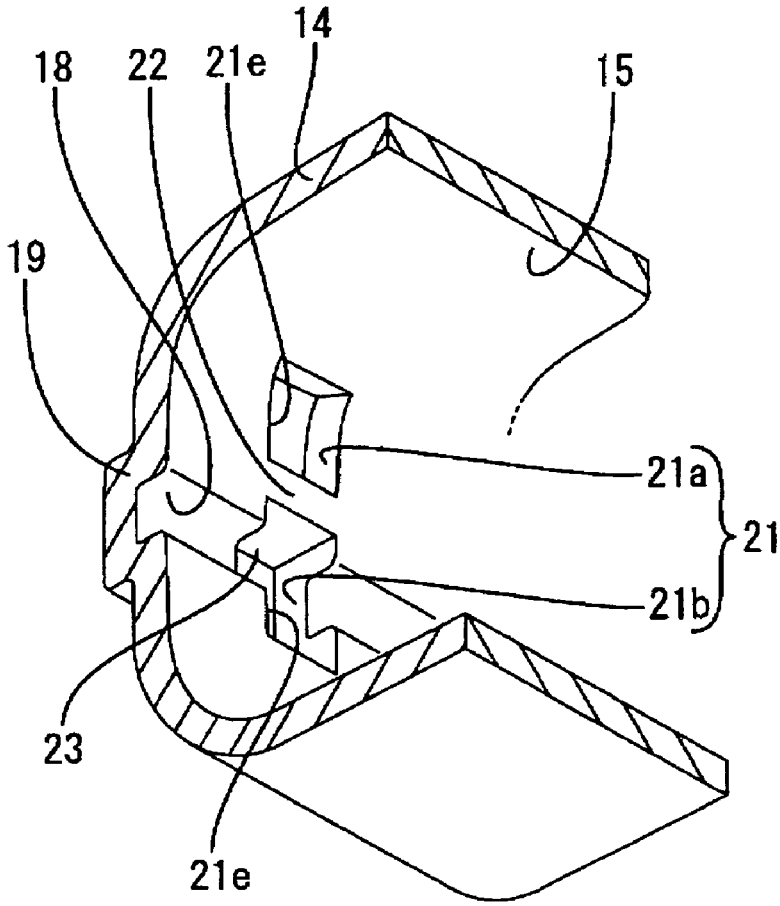
FIG. 9 is a schematic perspective view of the fittable tube when viewed from inner side.
Figure 10:
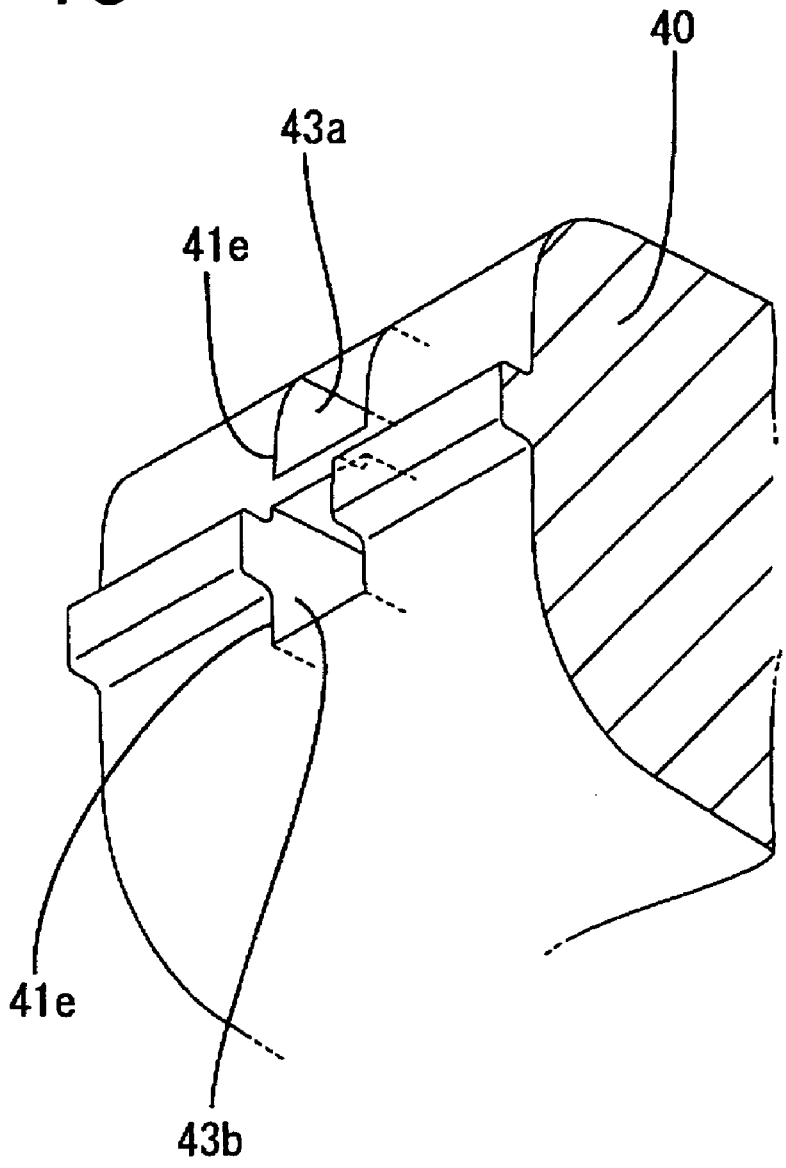
FIG. 10 is a schematic perspective view of the first mold.

The first mold 40 is removed forward in this state. An angled rear edge 41*e* (see FIG. 10) of the opening edge of the molding fitting space 41 is substantially normal to the first mold removing direction RD1 and passes angled front edges 21*e* (see FIG. 9) of the divided holes 21*a*, 21*b* in the inner peripheral surface of the already molded fittable tube 14. The edges 21*e* are substantially normal to the first removing direction RD1 and the edges 21*e* of the divided holes 21*a*, 21*b* could catch the edge 41*e* of the mold fitting space 41 if the edges 21*e* of the fittable tube 14 are displaced inward.

Figure 11:
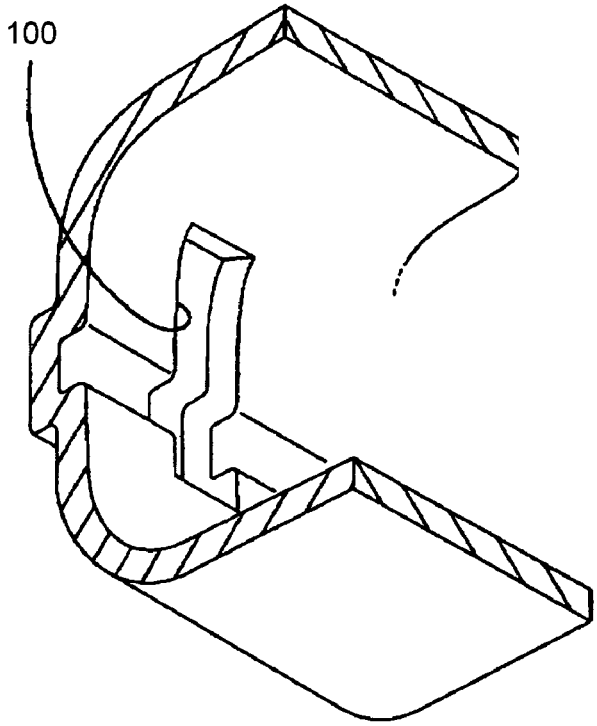
FIG. 11 PRIOR ART
FIG. 11 is a schematic perspective view of a prior art fittable tube.

However, the beam 22 divides the opening of the mold-removal hole 21 corresponding to the mold fitting space 41 into the upper and lower divided holes 21*a*, 21*b*. The beam 22 extends between the front and rear edges of the mold-removal hole 21 that are substantially normal to the first removing direction RD1. Thus, the dimensions of the openings of the divided holes 21*a*, 21*b* along the vertical dimension VD, i.e. normal to the first removing direction RD1, are shorter than the openings of the mold-removal hole 21 and the mold fitting space 41 (preferably about ½). Hence, the edges of the openings of the divided holes 21*a*, 21*b* do not displace inward, and the opening edge 41*e* of the mold fitting space 41 of the first mold 40 will not catch the opening edges 21*e* of the divided holes 21*a*, 21*b*. This distinguishes from the mold-removal hole 100 of FIG. 11 that has no beam and a large vertical dimension. Accordingly, the connector can be made smaller as compared to a case where the inner surface of the fittable tube 14 is widened or stepped along the mold removing direction as a catch preventing means.

The rib 23 extends in the first removing direction RD1 along the outer surface of the beam 22, and hence improves the rigidity of the beam 22. Thereof, the inward displacement of the opening edges of the divided holes 21*a*, 21*b* accompanied by the deformation of the beam 22 is even less likely. As a result, the interference of the opening edges of the divided holes 21*a*, 21*b* with the first mold 40 can be securely avoided.

The thick portion 19 is formed on the outer surface of the fittable tube 14 over a range including areas along the opening edges 21*e* of the divided holes 21*a*, 21*b*. Thus, inward displacement of the opening edges 21*e* is prevented more securely. Further, the rib 23 is substantially continuous with the thick portion 19, and displacement of the rib 23 itself can be restricted and the reinforcing function (rigidity) by the rib 23 is improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Only one beam 22 is provided in one mold-removal hole 21 in the foregoing embodiment. However, a plurality of beams may be provided in one mold-removal hole according to the present invention.

The beam 22 has a constant width over the entire length in the foregoing embodiment. However, a half-dividing member may be shaped so that its width changes along the first removing direction RD1 (for example, it may take a trapezoidal shape, a barrel shape, a spool shape or a rhombic shape) according to the present invention.

Although the beam 22 extends parallel to the first removing direction RD1 in the foregoing embodiment. However, it may extend oblique to the first removing direction RD1 according to the present invention.

Although the beam 22 is straight in the foregoing embodiment, it may be nonlinear according to the present invention.

The rib 23 is formed on the outer surface of the beam 22 in the foregoing embodiment. However, the rib may not be provided.

Only one rib 23 is formed on the outer surface of the beam 22 in the foregoing embodiment. However, plural ribs may be formed on one beam.

The outer surface of the fittable tube 14 is thickened to form the thicker portion 19 in the foregoing embodiment. However, the fittable tube 14 may be made with no thick portion and a smooth outer surface.

The outer surfaces of the rib 23 and the thick portion 19 are substantially flush with each other in the foregoing embodiment. However, the outer surfaces of the rib 23 and the thick portion 19 may be offset.

Although the beam 22 has been described as being formed of resin in the foregoing embodiment, it may be formed of another material and/or comprise a reinforcing material such as a metal piece inserted by insert molding into the beam.

What is claimed is:

1. A connector housing unitarily molded from a synthetic resin and comprising:

at least one cavity extending substantially through the housing along a forward and backward direction;

an accommodation space extending substantially through the housing transverse to the forward and backward direction and communicating with the cavity;

a forwardly open fittable tube at least partly surrounding portions of the housing having the cavity;

a mount hole penetrating the fittable tube and aligned with the accommodation space for permitting a retainer to be inserted through the mount hole and into the accommodation space for locking at least one terminal fitting in the at least one cavity;

a mold-removal hole penetrating the fittable tube at a side substantially opposite from the mount hole;

at least one beam extending between two edges of the mold-removal hole that are substantially transverse to the forward and backward direction; and at least one rib formed on the outer surface of the beam and extending substantially parallel to the beam.

2. The connector of claim 1, wherein a thick portion is formed on an outer surface of the fittable tube over a range including an area extending along the edge of the mold-removal hole.

3. The connector of claim 2, wherein the rib is substantially continuous with the thick portion.

4. A connector housing unitarily molded from a synthetic resin and comprising:

at least one cavity extending substantially through the housing along a forward and backward direction;

an accommodation space extending substantially through the housing transverse to the forward and backward direction and communicating with the cavity;

a forwardly open fittable tube at least partly surrounding portions of the housing having the cavity;

a mount hole penetrating the fittable tube and aligned with the accommodation space for permitting a retainer to be inserted through the mount hole and into the accommodation space for locking at least one terminal fitting in the at least one cavity;

a mold-removal hole penetrating the fittable tube at a side substantially opposite from the mount hole;

at least one beam extending between two edges of the mold-removal hole that are substantially transverse to the forward and backward direction; and a thick portion formed on an outer surface of the fittable tube over a range including an area extending along at least one of the edges of the mold-removal hole.

* * * * *